US005096101A

United States Patent [19]

Norman et al.

[11] Patent Number: 5,096,101

[45] Date of Patent: Mar. 17, 1992

[54] GARMENT HANGER WITH LOCKING INFORMATION TAB

[75] Inventors: Michael D. Norman, Edison, N.J.; Clifford A. Deupree, Newport Beach, Calif.; Michael Elchisak, Shenandoah, Pa.

[73] Assignee: A & E Products Group, a Division of Carlisle Plastics, Inc., Woodbridge, N.J.

[21] Appl. No.: 687,661

[22] Filed: Apr. 19, 1991

[51] Int. Cl.[5] ..... A47G 25/14; G09F 3/00

[52] U.S. Cl. ..... 223/85; 223/92; 40/322

[58] Field of Search ..... 223/85, 88, 92, 95; 211/113; 40/322

[56] References Cited

U.S. PATENT DOCUMENTS

| | | | |
|---|---|---|---|
| D. 244,197 | 5/1977 | Ostroll | D19/13 |
| 3,949,914 | 4/1976 | Ostroll | 223/85 |
| 4,115,940 | 9/1978 | Phillips | 223/85 |
| 4,997,114 | 3/1991 | Petrou | 223/88 |

*Primary Examiner*—Werner H. Schroeder
*Assistant Examiner*—Bibhu Mohanty
*Attorney, Agent, or Firm*—Blum Kaplan

[57] ABSTRACT

A garment hanger including a body having a hook member and a tab holder. The tab holder includes an enlarged region. An information tab includes resilient fingers which are captured by the enlarged region to substantially prevent removal of the tab from the tab holder.

17 Claims, 2 Drawing Sheets

GARMENT HANGER WITH LOCKING INFORMATION TAB

BACKGROUND OF THE INVENTION

This invention is directed generally to a garment hanger with locking information tab and, in particular, to a garment hanger with a locking information tab that essentially prevents removal of the tab from the hanger.

While garment hangers have taken many forms, garment hangers with removable information tabs are known in the art as exemplified, for example, by U.S. Pat. No. 4,115,940 (Phillips) owned by the assignee of the present invention. U.S. Pat. No. 4,115,940 is directed to a garment hanger with an information tab removably coupleable to a tab holder extending intermediate the hook and body of the hanger. The information tab in U.S. Pat. No. 4,115,940 was designed to be removable and changeable to convey proper information about the garment hanging on the hanger.

Such easily removable tabs as disclosed in U.S. Pat. No. 4,115,940 are quite satisfactory for appropriate applications. However, with increased concerns about child safety, especially when such garment hangers are taken home, it would be desirable to provide a more secure locking system for locking the information tab on the hanger.

Accordingly, it is desired to provide a garment hanger with a locking information tab that essentially prevents removal of the tab from the hanger after being secured thereon.

SUMMARY OF THE INVENTION

Generally speaking, in accordance with the present invention, a garment hanger including a body having a hook, is provided A tab holder is formed on the body for holding an information tab. The tab holder includes an enlarged region and the information tab includes projections which are captured by the enlarged region to essentially prevent removal of the tab from the tab holder.

In a preferred embodiment, the tab holder includes enlarged spaced regions having essentially triangular cross-sections. The information tab includes opposing projections which engage intermediate the two spaced regions to lock the tab on the holder. The ends of the tab are curved inwardly and abut the tab holder below the spaced regions to prevent grasping thereof.

Accordingly, it is an object of the present invention to provide a garment hanger having a locking information tab which essentially prevents removal of the tab from the hanger.

Another object of the present invention is to provide a garment hanger having an improved tab holder which cooperates with an improved information tab to essentially prevent removal of the tab from the holder.

A further object of the present invention is to provide an improved information tab for a garment hanger which is essentially non-removable from the hanger.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
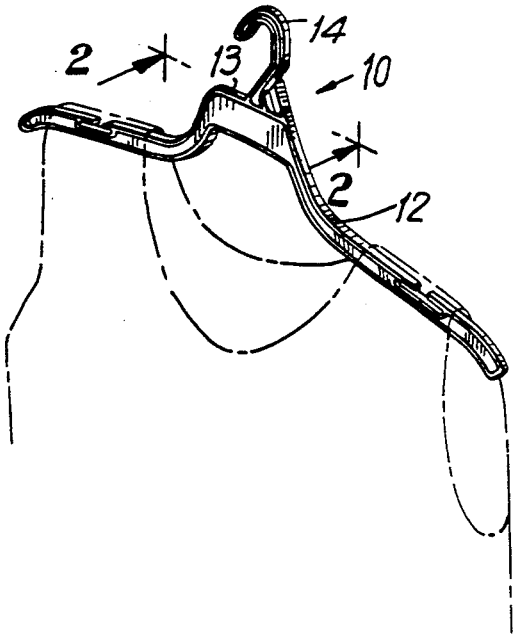
FIG. 1 is a perspective view of a garment hanger with a locking information tab constructed in accordance with a preferred embodiment of the present invention shown with a garment hung thereon in phantom.
Figure 3:
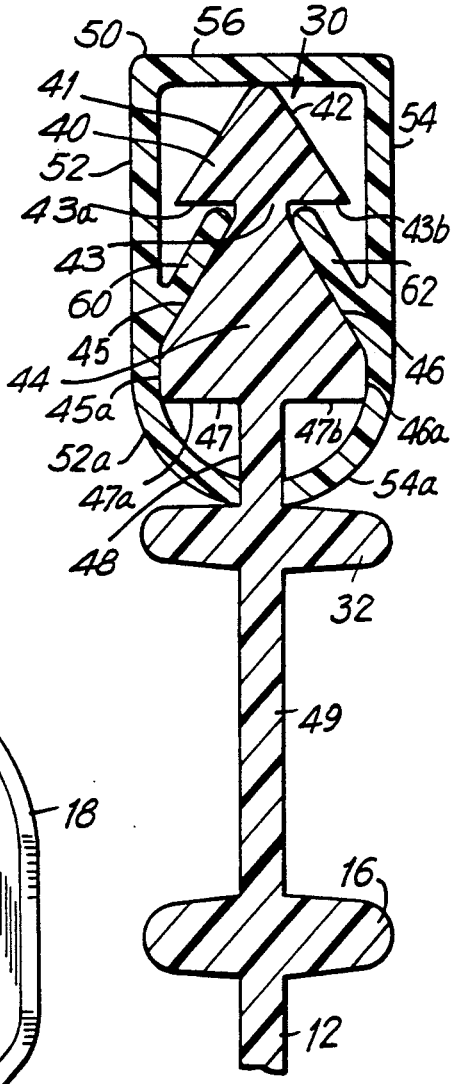
FIG. 3 is an enlarged sectional view taken along line 3—3 of FIG. 2.
Figure 2:
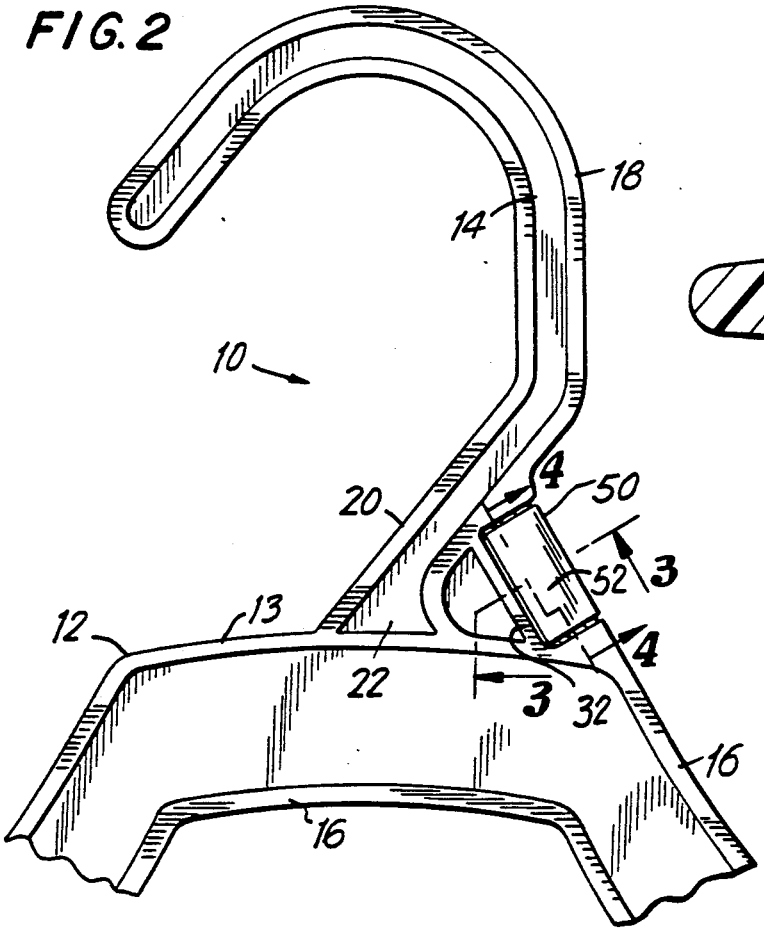
FIG. 2 is a partial enlarged front elevational view looking in the direction of arrows 2—2 of FIG. 1.
Figure 4:
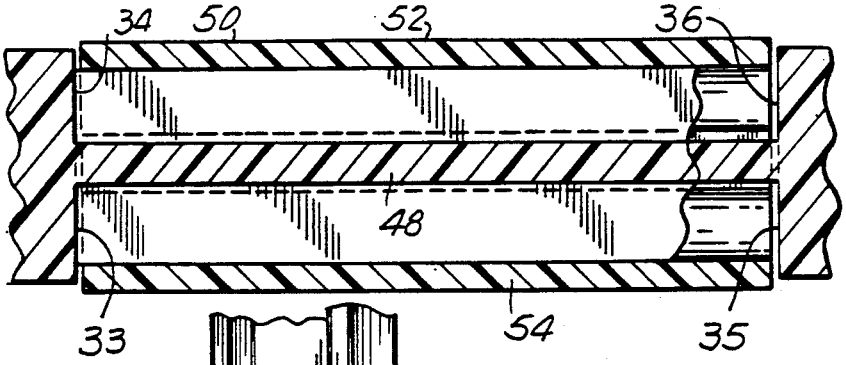
FIG. 4 is an enlarged sectional view taken along line 4—4 of FIG. 2.

The drawings generally depict a garment hanger with a locking information tab, specifically an information tab which includes pincer-type locking action. The tab substantially envelops and locks on a tab holder formed as part of the hanger.

In a preferred embodiment of the present invention, the tab holder is configured to include a first cross-section shaped as an arrow head or triangle, and a second cross-section also shaped as an arrow head or triangle and terminating at a rib of the hanger. The information tab is U-shaped in cross-section and includes inwardly projecting fingers which grab intermediate the arrow heads of the tab holder. The free ends of the tab curve inwardly and grab the tab holder below the second arrow head. This construction creates a tight locking fit which substantially prevents removal of the tab from its holder when in place thereon.

Reference is made to FIGS. 1 through 5 of the drawings wherein a garment hanger, generally indicated at 10, and constructed in accordance with a preferred embodiment of the present invention, is depicted. Hanger 10 is preferably molded from a thermoplastic material and includes a hanger body 12 having a hook member 14 joined thereto or molded therewith. Hanger body 12 is generally planar and has a transverse reinforcing wall or rib, forming an I-beam construction extending around 16 its periphery. Similarly, hook member 14 is generally planar and includes a transverse reinforcing wall or rib 18 extending around its periphery. Hook member 14 has a base section 20 extending at an angle to hanger body 12 which includes a widened section 22 at the position where hook member 14 joins shoulder 13 of hanger body 12.

Hanger 10 includes a tab mounting member or tab holder 30 which extends intermediate shoulder 13 of hanger body 12 and angled base section 20 of hook member 14. In a preferred embodiment, the holder 28 is integrally molded with hanger 10. It is noted, however, that tab holder 28 need not be integrally formed and may be positioned at other places on hanger 10, such as on hook 14.

Tab holder 30 is generally configured in a rectangular shape extending in the space between rib 16 of body 12 and rib 18 of hook 14. Tab holder 30 terminates below at a rib 32 also having an I-beam configuration. The sides 34 and 36 of tab holder 30 are formed by walls 33 and 35 extending below a cut-out region 38 in rib 16.

Tab holder 30 includes an upper enlarged region 40 which is triangular in cross-section to form a first arrow-head shape. Region 40 is defined by sloping sidewalls 41 and 42, and a base 43 having a pair of opposing ledges 43*a* and 43*b*. A lower enlarged region 44 is formed below region 40 and is also triangular in cross-section to form a second arrow-head shape. Region 44 is defined by sloping sidewalls 45 and 46 which terminate in lateral portions 45*a* and 46*a*, respectively, and a base 47 having a pair of opposing ledges 47*a* and 47*b*. A thin wall 48 extends from base 47 of region 44 to rib 32. A second thin wall 49 extends from rib 32 to rib 16. Tab holder 30 is adapted to receive and secure an information tab 50.

Information tab 50 is preferably formed from a resilient thermoplastic material as a plastic extrusion. Information tab 50 is generally U-shaped in cross-section and includes opposing legs 52 and 54 extending from a top wall 56 upon which information, such as the size of a garment, is disposed. The ends 52*a* and 54*a* of legs 52 and 54, respectively, are curved inwardly as depicted to define a gap 58. Tab 50 also includes inwardly extending resilient projections in the form of fingers 60 and 62 which extend from the inside walls forming legs 52 and 54, respectively toward top wall 56.

Figure 5:
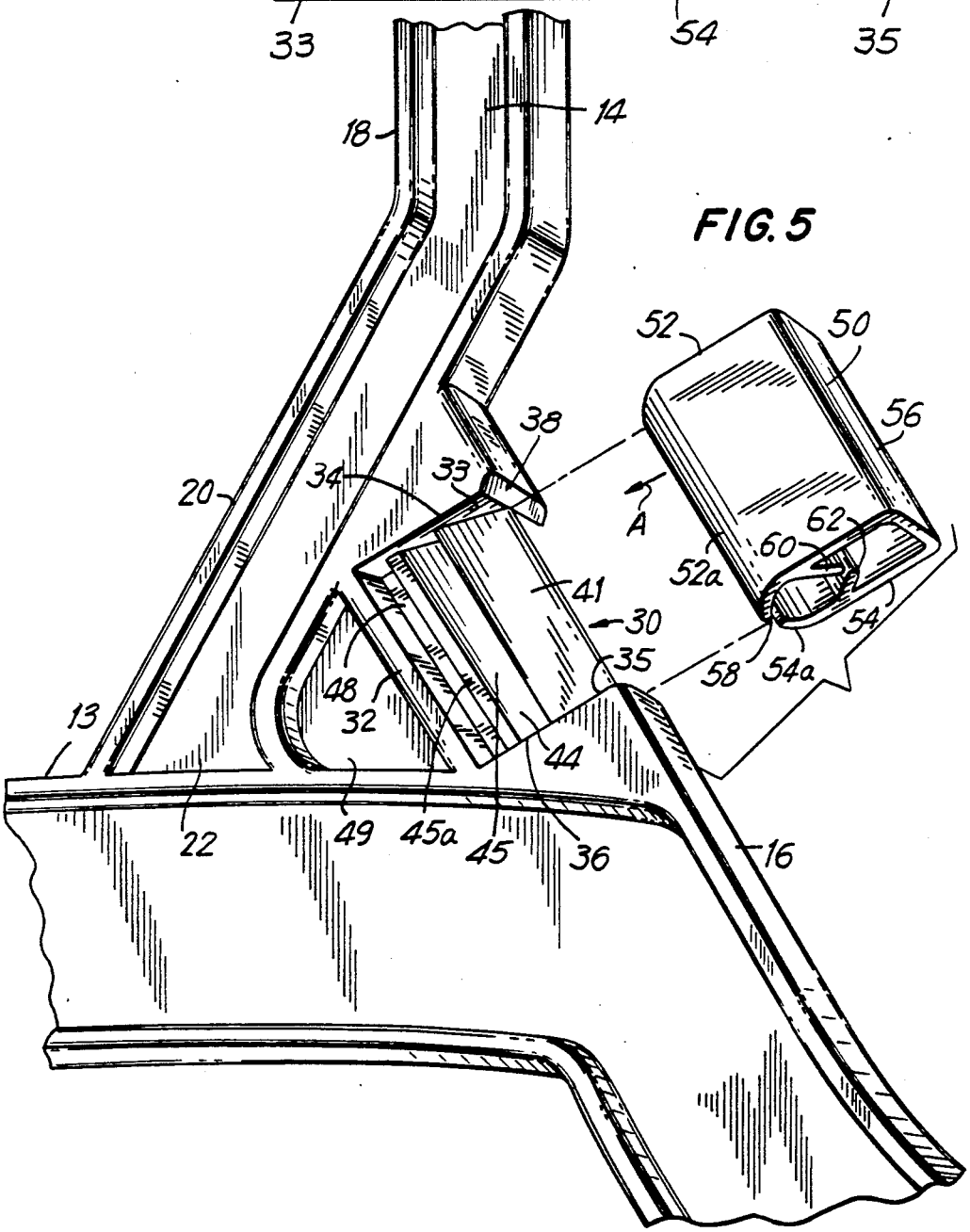
FIG. 5 is a partial enlarged perspective view similar to FIG. 2 showing the information tab before insertion on the hanger.

Information tab 50 is inserted on tab holder 30 in the direction of arrow A as shown in FIG. 5. Curved ends 52*a* and 54*a* of legs 52 and 54 will spread apart upon contact with sidewalls 41 and 42 of region 40 and will spread apart again by contact with sidewalls 45 and 46 of region 44. After passing lateral portions 45*a* and 46*a*, curved ends 52*a* and 54*a* will abut against thin wall 48. At the same time, fingers 60 and 62 will be forced towards legs 52 and 54, respectively, as they ride over sloped sidewalls 41 and 42.

Once fingers 60 and 62 pass beyond sidewalls 41 and 42, they move inwardly towards their normal position and lock under ledges 43*a* and 43*b*, respectively, of base 43. Fingers 60 and 62 rest against sidewalls 45 and 46, respectively, of region 44.

Due to the inward curved construction of the ends of legs 52 and 54 which bear against wall 48 and rib 32, and the resilient fingers 60 and 62 locking under base 43, a doubly secure locking system is provided. The tab is essentially locked on the tab holder and is therefore child-proof. The same construction could be provided on the hook of the hanger body to provide a secure locking of the tab on the hook itself.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A garment hanger comprising a body having a hook member joined to said body at one end thereof, a tab holder formed on said body, said tab holder including a first region having an essentially triangular cross-section and a second region having an essentially triangular cross-section, and an information tab having side walls defining an internal channel including locking means in said channel for locking said information tab on said tab holder when said information tab is coupled to said tab holder, said locking means having at least a first internal resilient finger in said channel which engages and locks intermediate said first and second regions to essentially prevent manual removal of said information tab from said tab holder.

2. The garment hanger as claimed in claim 1, wherein said information tab is generally U-shaped and includes first and second opposing legs having ends defining a slot therebetween, said ends of said first and second legs being curved inwardly towards said tab holder.

3. The garment hanger as claimed in claim 2, wherein said information tab includes a second internal resilient finger, said first and second internal fingers engaging intermediate said first and second regions on said tab holder to lock said information tab on said tab holder.

4. The garment hanger as claimed in claim 2, wherein said tab holder includes a rib, said curved ends of said first and second legs being positioned adjacent said rib.

5. The garment hanger as claimed in claim 1, wherein said first region includes first and second sloping sidewalls and a base, said base being adjacent said second region and having first and second opposing ledges, said first internal finger on said information tab being captured under one of said first and second ledges when said information tab is on said tab holder.

6. The garment hanger as claimed in claim 3, wherein said first region includes first and second sloping sidewalls and a base, said base being adjacent said second region and having first and second opposing ledges, said first and second internal fingers on said information tab being captured under said first and second ledges, respectively, when said information tab is on said tab holder.

7. The garment hanger as claimed in claim 6, wherein the curved ends of said first and second legs of said information tab are positioned below said second region when said information tab is on said tab holder.

8. The garment hanger as claimed in claim 6, wherein said second region includes third and fourth sloping sidewalls and a second base, said first and second internal fingers of said information tab resting against said third and fourth sloping sidewalls of said second region when said information tab is on said tab holder.

9. A garment hanger as claimed in claim 8, wherein said tab holder includes a thin wall extending from the second base of said second region, said curved ends of said first and second legs of said information tab abutting against said thin wall when said information tab is on said tab holder.

10. A garment hanger information tab for use on a garment hanger having a tab holder, said tab holder including a ledge, comprising a U-shaped body having a top wall and first and second legs defining a slot and internal channel therebetween, said U-shaped body having a first internal resilient finger extending upwardly towards said top wall and inwardly from said first leg in said channel, said first internal finger extending under said ledge of said tab holder to lock said body on said tab holder when said body is on said tab holder.

11. The garment hanger information tab as claimed in claim 10, wherein said body includes a second internal resilient finger extending inwardly from said second leg, said first and second resilient fingers adapted to extend under said ledge of said tab holder to lock said body on said tab holder when said body is on said tab holder.

12. A garment hanger information tab for use on a garment hanger having a tab holder, said tab holder including a ledge, comprising a U-shaped body having first and second legs defining a slot and internal channel therebetween, said U-shaped body having a first internal resilient finger extending inwardly from said first leg in said channel, said first internal finger extending under said ledge of said tab holder to lock said body on said tab holder when said body is on said tab holder, said first and second legs including free ends, the free ends of said legs being curved inwardly to define a gap therebetween.

13. A garment hanger for use with a U-shaped information tab having first and second legs with free ends that are curved inwardly, comprising a body having a hook member, a tab holder formed on said body, said tab holder having at least a first enlarged region which is essentially triangular-shaped in cross-section and a second enlarged region which is essentially triangular-shaped in cross-section positioned above said first enlarged region, said curved ends of said legs of said information tab being captured under said first enlarged region on said tab holder when said information tab is coupled to said tab holder.

14. The garment hanger as claimed in claim 13, wherein said first enlarged region includes first and second sloping sidewalls and a base.

15. The garment hanger as claimed in claim 14, wherein said base defines a ledge, said curved ends of said first and second legs being captured under said ledge when said information tab is coupled to said tab holder.

16. The garment hanger as claimed in claim 15, wherein said body includes a wall extending from said base of said first region, said curved ends of said first and second legs of said information tab abutting said wall when said information tab is coupled to said tab holder.

17. The garment hanger as claimed in claim 16, wherein said body includes a rib extending from said wall, said curved ends of said first and second legs of said information tab being adjacent said ribs when said information tab is coupled to said tab holder.

* * * * *